United States Patent [19]

Jackson et al.

[11] 3,989,367

[45] Nov. 2, 1976

[54] APPARATUS FOR CONTACTING A ROLLER TO A SURFACE TO BE CONTACTED

[75] Inventors: Earl V. Jackson, Penfield; Wayne F. Schoppe, Webster; Gino F. Squassoni, Pittsford; Peter J. Warter, Penfield, all of N.Y.

[73] Assignee: Xerox Corporation, Stamford, Conn.

[22] Filed: Sept. 25, 1974

[21] Appl. No.: 509,189

Related U.S. Application Data

[62] Division of Ser. No. 373,560, June 25, 1973, Pat. No. 3,860,336.

[52] U.S. Cl. ..... 355/3 P; 118/242; 118/258

[51] Int. Cl.[2] ..... G03G 15/00

[58] Field of Search ..... 118/258, 242, 241, 259, 118/260; 355/3 P; 101/269

[56] References Cited

UNITED STATES PATENTS

| | | | |
|---|---|---|---|
| 2,503,439 | 4/1950 | Hosmer et al. | 118/241 X |
| 2,538,945 | 1/1951 | Mortell | 118/242 |
| 2,666,411 | 1/1954 | Williams et al. | 118/241 X |
| 3,166,008 | 1/1965 | Lewandoski | 101/269 X |
| 3,516,387 | 6/1970 | Windsor | 118/242 X |
| 3,747,561 | 7/1973 | Helm | 118/259 |
| 3,800,743 | 4/1974 | Egnaczak | 118/241 X |

*Primary Examiner*—R. L. Moses

*Attorney, Agent, or Firm*—James J. Ralabate; Michael H. Shanahan; Charles E. Smith

[57] ABSTRACT

A roller and mount assembly contained on a movable carriage, the mount adapted to allow the roller to pivot in at least one major direction in response to non-uniform transverse contact between the roller surface and the surface to be contacted.

4 Claims, 5 Drawing Figures

APPARATUS FOR CONTACTING A ROLLER TO A SURFACE TO BE CONTACTED

CROSS-REFERENCE TO RELATED APPLICATIONS

This is a division of application Ser. No. 373,560, filed June 25, 1973 now U.S. Pat. No. 3,860,336.

BACKGROUND OF THE INVENTION

This invention relates to imaging machines and, in particular, to a photoelectrophoretic imaging machine. More specifically, this invention relates to new and improved machines for implementing the photoelectrophoretic process.

In the photoelectrophoretic imaging process black and white or full color images are formed through the use of photoelectrophoresis. An extensive and detailed description of the photoelectrophoretic process is found in U.S. Pat. Nos. 3,384,448 and 3,384,565 to Tulagin and Carreira, 3,383,993 to Yeh and 3,384,566 to Clark, which disclose a system where photoelectrophoretic particles migrate in image configuration providing a visual image at one or both of two electrodes between which the particles suspended within an insulating carrier is placed. The particles are electrically photosensitive and are believed to bear a net electrical charge while suspended which causes them to be attracted to one electrode and apparently undergo a net change in polarity upon exposure to activating electromagnetic radiation. The particles will migrate from one of the electrodes under the influence of an electric field through the liquid carrier to the other electrode.

The photoelectrophoretic imaging process is either monochromatic or polychromatic depending upon whether the photosensitive particles within the liquid carrier are responsive to the same or different portions of the light spectrum. A full-color polychromatic system is obtained, for example, by using cyan, magenta and yellow-colored particles which are responsive to red, green and blue light respectively.

The photoelectrophoretic imaging system disclosed in the above-identified patents may utilize a transparent flat electrode configuration for one of the electrodes used in establishing the electrical field across the imaging suspension. A photoelectrophoretic imaging machine having a stationary flat transparent electrode over which roller electrodes travel for rapid production of images in a sequential manner has been suggested in the prior art as described, for example, in U.S. Pat. No. 3,644,035. A belt drive mechanism in a photoelectrophoretic imaging machine is disclosed in Egnaczak et al. U.S. Pat. No. 3,647,290.

SUMMARY OF THE INVENTION

It is an object of this invention to provide an improved photoelectrophoretic imaging machine.

Another object of this invention is to provide a photoelectrophoretic imaging machine with means for uniformly contacting under pressure a roller against another surface.

Another object of this invention is to provide said contact by providing at least one roller whose axis is capable of a small amount of vertical tilt at the ends of the roller, and optimally also mounted in means capable of pivoting about an axis perpendicular and transverse to the direction of advancement of the roller.

Still another object of this invention is to provide a photoelectrophoretic imaging machine with a yoke mounting assembly for detachably mounting at least one roller.

Yet another object of this invention is to provide a machine drive mechanism for propelling a roller carriage which carries at least one roller over a transparent electrode and an aperture member underneath the transparent electrode. The drive mechanism is capable of propelling the roller carriage and roller at a greater velocity than the velocity of the aperture member.

These and other objects of this invention are accomplished by using a transparent electrode, typically a flat plate, over which, a carriage which carries at least one roller, typically a roller electrode, into contact with the transparent electrode. In some embodiments, two or more rollers may be used, one of which may be an image transfer roller. Imaging suspension applied between a roller electrode and the transparent electrode is exposed to electromagnetic radiation under the influence of an electric field to form an image. The roller is rotatably mounted to the carriage by a detachable yoke mounting assembly which enables the roller to tilt in a vertical plane. The detachable yoke mounting assembly and thus the roller also pivots about an axis parallel to the transparent electrode and perpendicular to the direction of advancement of the carriage and roller. A force is applied to the yoke mounting assembly to maintain a constant force between the roller and the transparent electrode irrespective of any irregularities in contact between the roller and the transparent electrode. Machine drive mechanism is used for propelling the carriage which carries at least one roller over the transparent electrode and also to propel at least one slit aperture plate under the transparent electrode. The carriage and roller are propelled at a greater rate of velocity than the velocity of the slit aperture plate. The carriage, mount, roller and related apparatus hereof may also be used to more uniformly contact any surface to be contacted, not only a transparent electrode as in photoelectrophoretic imaging.

BRIEF DESCRIPTION OF THE DRAWINGS

These and other objects and advantages will become apparent to those skilled in the art after reading the following description taken in conjunction with the accompanying drawings wherein.

DESCRIPTION OF THE PREFERRED EMBODIMENTS

The invention herein is described and illustrated in a specific embodiment having specific components listed for carrying out the functions of the apparatus. Nevertheless, the invention need not be thought of as being confined to such a specific showing and should be construed broadly within the scope of the claims. Any and all equivalent structures known to those skilled in the art can be substituted for specific apparatus disclosed as long as the substituted apparatus achieves a similar function. It may be that systems other than photoelectrophoretic imaging systems have been or will be invented wherein the apparatus described and claimed herein can be advantageously employed and such other uses are intended to be encompassed in this invention as described and claimed herein.

THE MACHINE COMPONENTS

(FIGS. 1–4)

Figure 1:
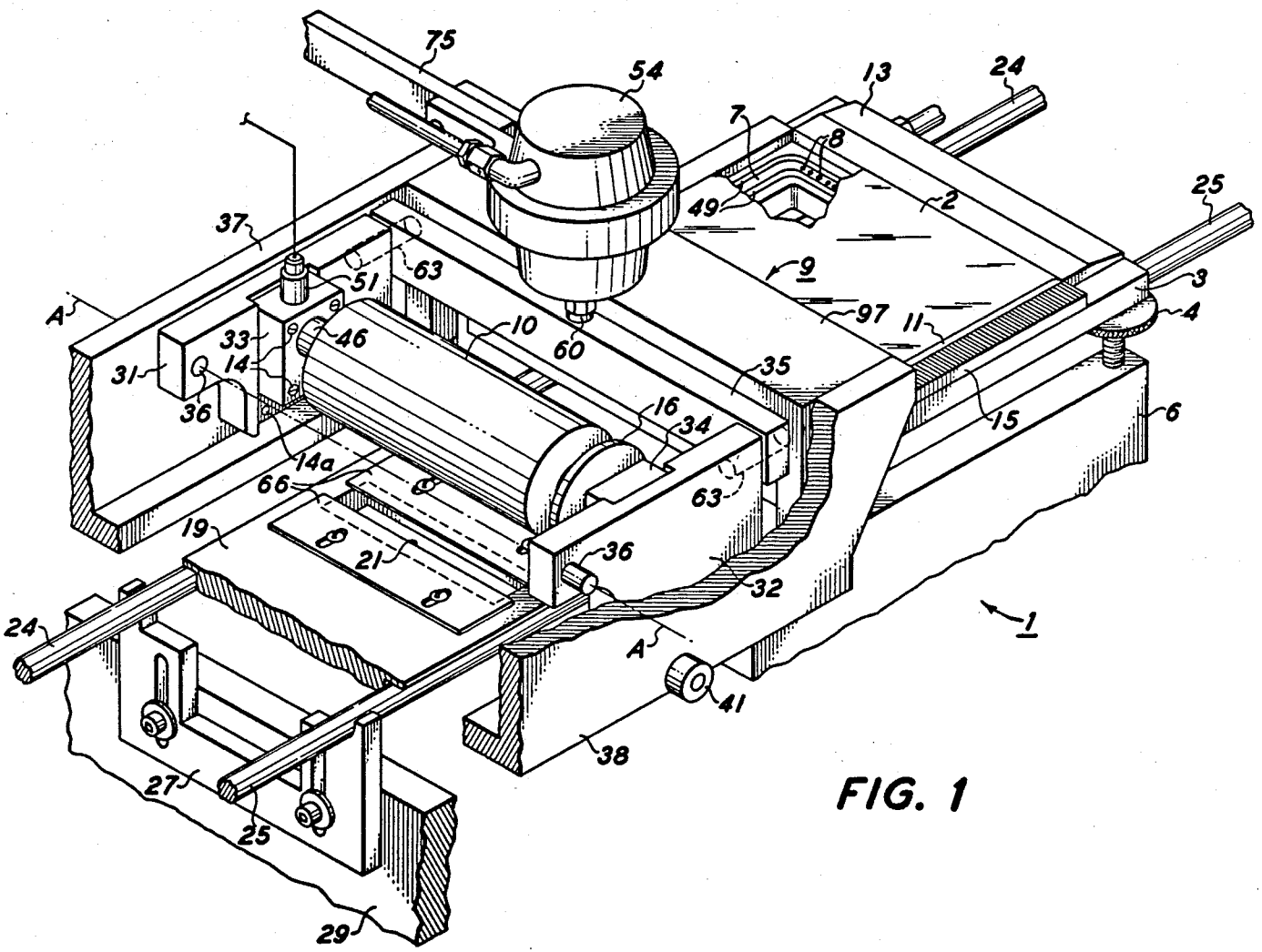
FIG. 1 is a perspective view of primarily the carriage portion of the photoelectrophoretic imaging machine.
Figure 2:
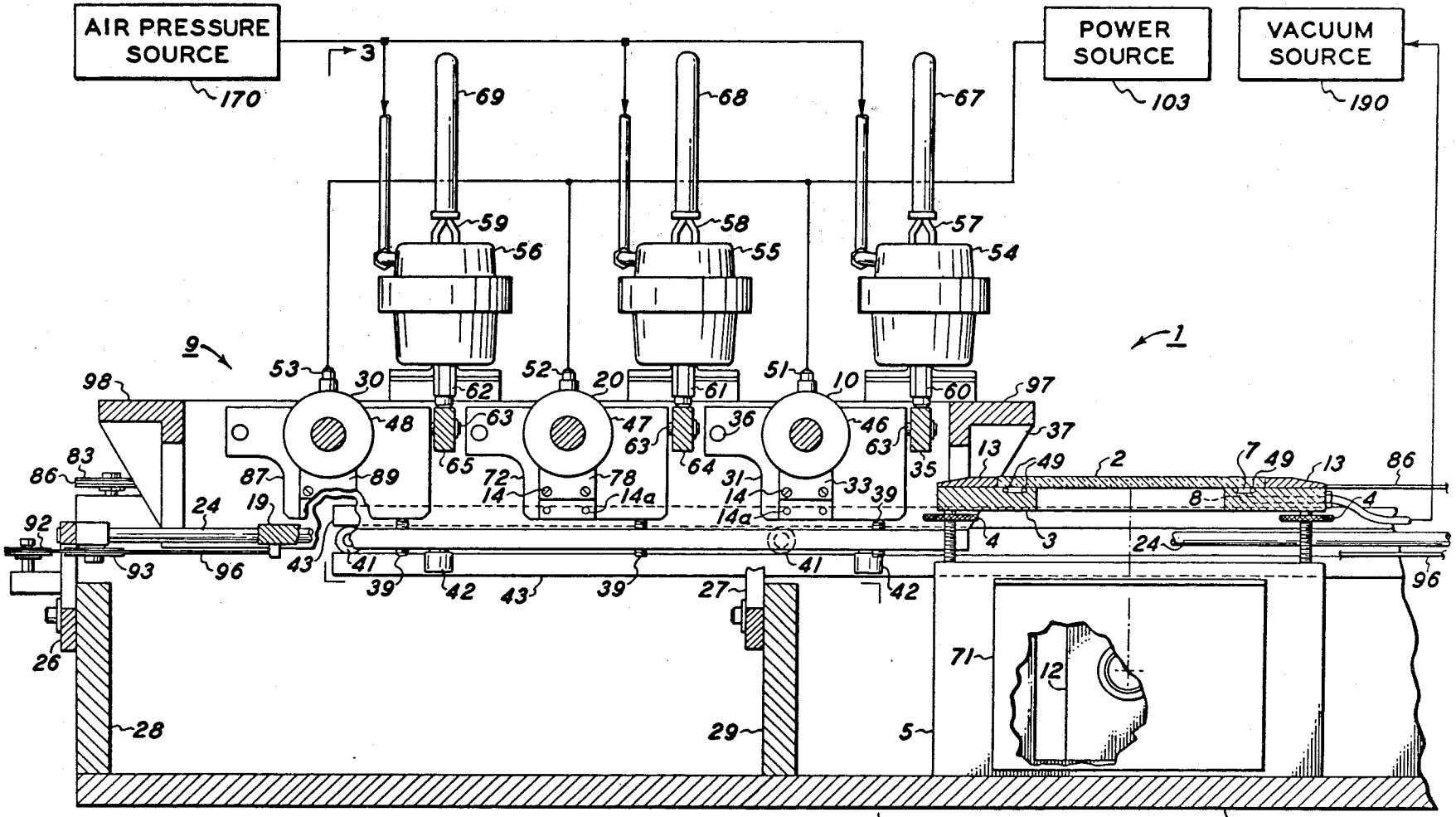
FIG. 2 is a side elevation sectional view of the overall photoelectrophoretic imaging machine according to the present invention.

Reference is made to FIGS. 1 and 2 in which various system components are illustrated. The photoelectrophoretic imaging machine 1, includes a flat stationary transparent electrode 2, located at substantially the midpoint on top of the machine. The stationary transparent electrode 2 or injecting electrode is formed of plate glass covered with a thin layer of tin oxide or other electrically conductive transparent material. A particular material suitable for the stationary electrode is available under the name of NESA glass, manufactured by Pittsburgh Plate Glass Co., Pittsburgh, Pa.

The stationary electrode 2 is shown seated on two rubber seals 49. The seals 49 are permanently attached to the metal frame 3 which is supported on leveling screws 4. The leveling screws 4, positioned at each corner of the metal frame 3 within supports 5 and 6, are manually adjustable to level the stationary electrode 2 in a substantially horizontal plane for optimum operation of the machine. The metal frame 3 is provided with left and right beveled ramps 13 permanently affixed to the top at the front and rear. The beveled ramps 13 at their highest point of elevation abut the front and rear edges of the stationary electrode 2. This enables rollers to pass up one ramp to clear the metal frame 3, across the stationary electrode 2 and down the other ramp.

It will be appreciated that the metal frame 3 and the rubber seals 49 cooperated with a portion of the lower surface of the stationary electrode 2 to define a chamber 7. A vacuum is created within the chamber 7 by coupling a vacuum source or pump 190 to the chamber through openings or inlets 8. The vacuum source is utilized to hold the stationary electrode 2 in position when rollers are passed over the stationary electrode 2 during photoelectrophoretic imaging. When the vacuum source is removed, the stationary electrode is held in place only by forces of gravity. This permits easy removal of the stationary electrode for visual examination of an image produced or color densitometry analysis. Thus, image quality analysis by visual examination to determine system performance is achieved in a simple and rapid manner.

Figure 3:
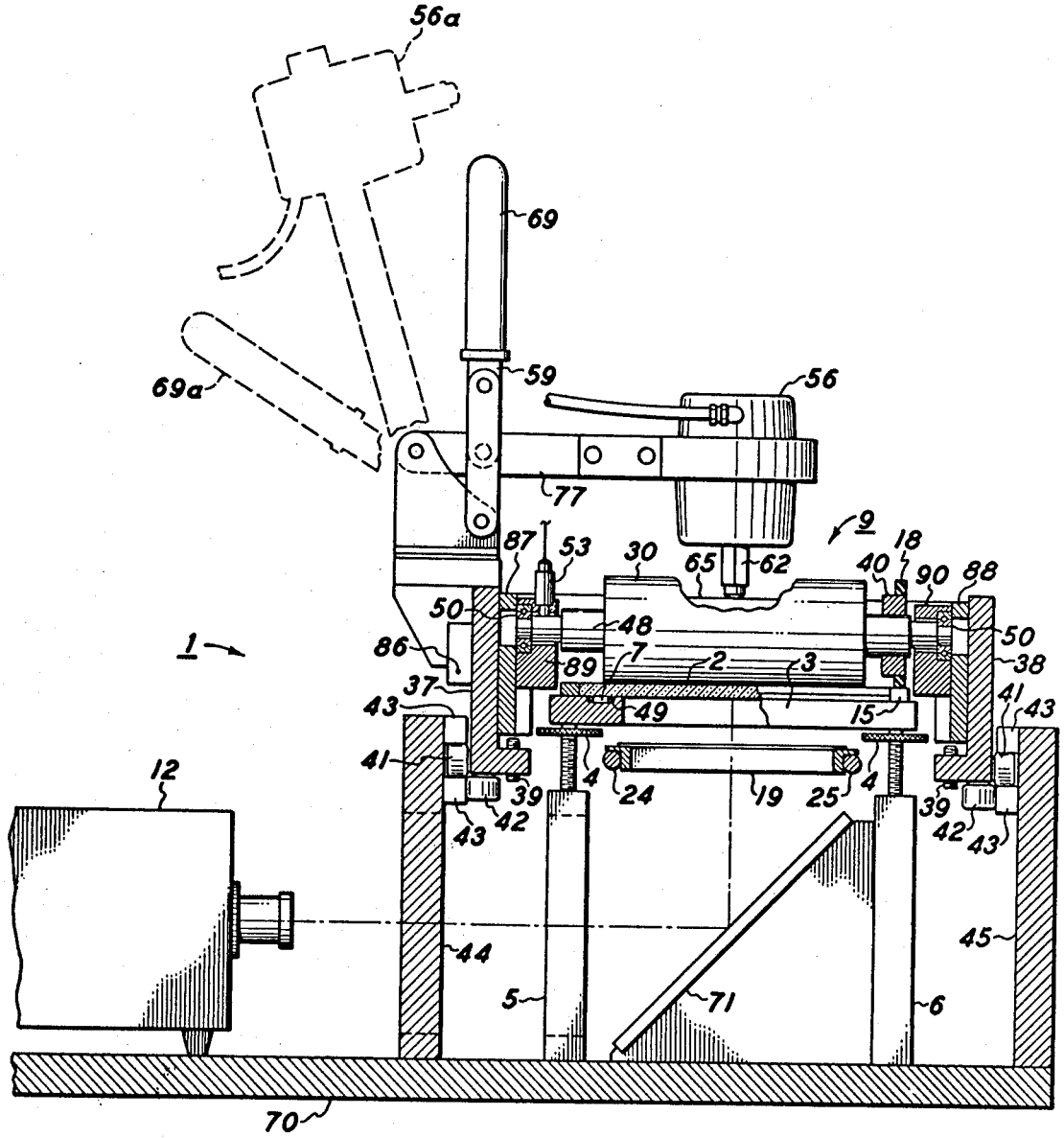
FIG. 3 is a cross-sectional view of the imaging machine taken along lines 3—3 in FIG. 2.

Referring now to FIGS. 1, 2 and 3, the photoelectrophoretic imaging machine 1 includes the roller carriage 9 which is mounted on horizontal guide rails 43 (see FIG. 3) that extend most of the length of the machine. The guide rails 43 are fixed to machine side walls 44 and 45 and define a channel for the carriage rollers. The carriage 9, that carries at least one roller and may carry two or more, includes front and rear frame flanges 97 and 98 respectively and generally L shaped sideboard frame members 37 and 38. The ends of sideboards 37 and 38 are both provided with pairs of carriage rollers 41 and 42 each mounted for rotation to sideboards 37 and 38 to engage the guide rails 43. The carriage rollers 41 are journaled on the outside of sideboards 37 and 38 and ride within the channel defined by rails 43, whereas carriage rollers 42, journaled beneath the rib of sideboards 37 and 38, engage the rim of the lower rail. Consequently, the carriage 9 is slidably supported for travel along the rails 43.

One of the unique features of this photoelectrophoretic imaging machine is the yoke mounting assembly which will be described in particularity hereinafter. The yoke mounting assembly enalbes roller electrodes to be mounted to sideboards 37 and 38 of roller carriage 9 for travel therewith. In the present photoelectrophoretic imaging machine three roller electrodes may be detachably mounted on roller carriage 9 by separate yoke mounting assemblies, and carried by roller carriage 9 over and across the stationary electrode 2 in the manner described hereinearlier.

The first roller electrode 10 is a blocking electrode of conventional design having an electrically conductive inner core overcoated with an electrically insulating elastomer. An image is formed on the stationary electrode 2 by coating roller electrode 10 or stationary electrode 2 with photoelectrophoretic ink and by passing roller electrode 10 over stationary electrode 2. The stationary electrode 2 is grounded by grounding strip 11 attached to an edge of the stationary electrode 2. The grounding strip 11 enables a difference of electrical potential to be applied between the stationary electrode 2 and the roller electrode 10. Typically, the stationary electrode 2 is electrically grounded and the roller electrode 10 is coupled to a voltage source 103 via electrical connector 51 of at least ±2,000 volts, as an example. The voltage source 103 is a high voltage D.C. power supply capable of both negative and positive variable outputs. The electric field established between the electrodes by the voltage source 103 causes the photosensitive ink particles exposed to light to migrate away from the stationary electrode. The ink particles remaining on the stationary electrode typically form the desired image is a positive charge from a positive exposure is desired. The ink is exposed to electromagnetic radiation to which it is responsive, such as visible light, through the stationary electrode by means of the exposure mechanism or projector 12. The projector is positioned on machine frame 70 to continuously project an image reflected by mirror 71 through the stationary electrode to expose imaging suspension between stationary electrode 2 and the first roller electrode 10.

The second roller electrode 20 carried by roller carriage 9, is also a blocking electrode composed of an electrically insulating elastomer material overcoating a conductive inner core. This second roller 20 is also coupled to the voltage source 103 via electrical connector 52 but not necessarily of the same potential as that of roller 10. The second roller 20, however, is not coated with photoelectrophoretic ink but may be used as a means to subject to a field ink subjected to a field during the passage of the first roller electrode 10. This subsequent subjection of the ink to an electric field and exposure to of the suspension to light is found to improve the quality of the image produced. The effect of the second roller electrode 20 is a repeat of the first roller electrode 10 and can be omitted from the imaging operation.

The third roller 30 is a blocking electrode which may be utilized as a transfer roller. In some embodiments, it may be desired to omit the second roller 20 from the roller carriage and instead roller 30 used as a repeat of roller 10. Alternately, the image formed on the stationary electrode 2 may be transferred to a recording sheet by means of roller 30. The recording sheet (not shown) is typically a paper material made from cloth or wood fibers and of a quality selected to suit the needs of a particular user. A sheet-feeding mechanism, as described in U.S. Pat. No. 3,644,035, or hand feeding, may be employed for loading a sheet onto the surface of the roller 30 prior to passing over the stationary electrode 2 and for ejecting the sheet from the transfer roller 30 after an image has been transferred to the sheet. The roller 30 is also coupled to the voltage source 103 via electrical connector 53. It may be desirable in order for the optimum image transfer to take place when roller 30 is used as a transfer roller that the voltage to roller 30 be reversed in polarity from that of rollers 10 and 20.

The three roller electrodes may be independently rotated by an auxiliary drive mechanism when the roller carriage 9 and rollers pass over the stationary electrode 2. The metal track 15 with a roughened upper surface, is attached on top of plate 3, extending along one edge of the stationary electrode 2. When the carriage 9, which carries roller electrodes 10, 20 and 30, passes over the stationary electrode 2, the resilient discs 16, 17 and 18 carried on roller electrodes 10, 20 and 30 respectively, engage the roughened surface of track 15 causing translational rotation of the roller electrodes to bring them into non-skidding roller surface contact with stationary electrode 2. The resilient discs 16, 17 and 18 are formed over hubs 40 and the shaft of the roller electrodes.

The optical system used to expose ink or imaging suspension between roller and stationary electrodes includes the transparency projector 12 of conventional design and the plane mirror 71. The projector 12 typically includes means for holding a transparency, the lamp 191, for illuminating the transparency means for collecting the radiation passing through the transparency and means for focussing a light image, for example, the full frame of the transparency projected onto mirror 71 to the plane of the stationary electrode 2 so that the interface or nip between the roller and stationary electrode 2 sees a flowing image of successive portions of the exposed image as the roller traverses across the stationary electrode 2. The transparency projector 12 and mirror 71 are mounted on the machine frame 70 with the mirror 71 positioned at a 45° angle to a light ray normal to the stationary and roller electrodes and the projector aimed generally at right angles to the path traveled by rollers 10, 20 and 30. The mirror 71 converts the right reading light image of a transparency to a reverse reading image on the stationary electrode 2. However, the image is transferred to a sheet so that the reverse reading image is once again right reading.

The optical system used in this photoelectrophoretic imaging machine includes the movable slit aperture plate 19 for projecting a flowing, transverse portion by transverse portion, light image or pattern to the advancing nip or interfacing between the roller and stationary electrodes. The slit aperture plate 19 is used to ensure that the ink is not pre or post exposed to the image absent the electrical field which is applied between the two electrodes; in other words, to expose only during application of the highest electrical field. The slit aperture plate 19 includes three exposure slits 21, 33 and 23 that correspond to associating rollers 10, 20 and 30, respectively. The slit aperture plate 19 is mounted for travel directly beneath the rollers and carriage 9, and at a predetermined location, a narrow image pattern is projected to the ink or imaging suspension through the slits between adjustable light stops 66. The width of the slits 21, 33 and 23, which can be increased to a maximum of 1 inch or decreased to approximately 0 inches by light stops 66, substantially defines the imaging region. It might be noted that when the third roller 30 is used as a transfer roller in the manner described herein supra, exposure of roller 30 may be in the dark by completely closing off slit 23. Also, whenever a roller is omitted, the associating exposure slit is sealed or closed off. In order to correct for parallax, the slit aperture plate 19 should be advanced at a slower rate of velocity than that of the rollers 10, 20 and 30 across the stationary electrode 2 because the slit aperture plate 19 has a shorter distance to travel. This difference in velocity enables a roller electrode and respective associating exposure slits to be correctly aligned at the exact point of image exposure throughout the advance of the roller across the stationary electrode 2 to minimize parallax. For example, when the roller electrode 10 first contacts the stationary electrode 2, the aperture slit 21 is slightly in advance of the nip and when the roller electrode 10 exits from the stationary electrode 2, the aperture slit 21 is slightly behind.

Thus, the machine drive mechanism for the machine which will be described more particularly infra, is designed such that the slit aperture plate 19, which carries the exposure slits, travels at a slightly slower velocity than that of the carriage and rollers. Upon activation of the machine drive mechanism, the slit aperture plate 19 travels beneath the carriage 9 and rollers 10, 20 and 30 on support rods 24 and 25, the carriage 9 and rollers passing over the stationary transparent electrode 2 and the slit aperture plate 19 passing underneath the stationary transparent electrode. The support rods 24 and 25 are affixed on rod brackets 26 and 27 which are supported by machine inner walls 28 and 29. The rod brackets 26 and 27 are adjustable to raise and lower the elevation of the slit aperture plate 19.

YOKE MOUNTING ASSEMBLY (FIGS. 1, 2 and 3)

Each of the three roller electrodes is connected to the roller carriage 9 by means of a yoke mounting assembly. The yoke mounting assemblies are identical so only one yoke mounting assembly will be described in detail.

The yoke mounting assembly for mounting roller electrode 10 includes side plate 31 and 32, bearing blocks 33 and 34 and beam 35. The yoke mounting assembly for mounting roller electrode 20 includes side plates 72 and 73 (not shown), bearing blocks 78 and 79 (not shown) and beam 64. The yoke mounting assembly for mounting roller electrode 30 includes side plates 87 and 89, bearing blocks 89 and 90 and beam 65. The side plates are provided with pivot pins 36 journaled to one end of the side plate. These pivot pins 36 enable the two side plates and thus the beam 35 and roller 10 to pivot about pivot pins 36. One of the unique features of this photoelectrophoretic imaging machine is the ability of the rollers to pivot about pivot pins 36 when a roller encounters a surface irregularity during an image pass over the stationary electrode 2. These pivot pins 36 are machined to fit within bores contained in roller carriage sideboard members 37 and 38. Side plates 31 and 32 are formed with a recess to recieve bearing blocks 33 and 34 respectively. The bearing blocks 33 and 34 are secured in a suitable manner, for example, by set screws 14, within the recess of the side plates 31 and 32. The bearing blocks are positioned according to the size or diameter of the roller electrode being used. The bearing blocks are moved vertically upward for increased roller diameters and downward for decreased roller diameters by means of set screws 14 within holes 14*a*. Typically, this machine can accommodate roller electrodes of diameters between about 1 and 4 inches in diameter. The three roller electrodes can all be of the same diameter or of mixed diameters.

The yoke mounting assembly for roller 10 includes the beam 35 which is joined to ends of side plates 31 and 32 by cylindrical dowels 63. The dowels 63 are machined to fit loosely within oversized holes in the beams and snug within ends of the side plates. This feature, along with the design of the roller shafts, permits ends of the roller to tilt in a vertical plane. The shafts 46, 47 and 48 of roller electrodes 10, 20 and 30 respectively are journaled at the ends for machine fit into roller bearings 50 housed within the bearing blocks. A small clearance, however, is provided between the shaft and the bearing blocks (see FIG. 3). Thus, the capability for a small amount of differential vertical tilt is provided at the ends of the roller axis upon the roller encountering a surface irregularity by bending of the roller shaft.

Diaphragm air cylinders 54, 55 and 56 are employed to provide a constant downward load through the yoke mounting assemblies to rollers 10, 20 and 30 respectively. The diaphragms are mounted on levers 57, 58 and 59 anchored to carriage sideboard 37 and are carried by the carriage 9 when the carriage makes an image pass. Diaphragms 54, 55 and 56 are constructed with movable friction-free plungers 60, 61 and 62 respectively. The diaphragms are coupled to a variable air pressure source 170 so as to provide a maximum pressure of 50 p.s.i. Diaphragm plungers 60, 61 and 62 are brought into intimate contact with yoke mounting assembly beams 35, 64 and 65 respectively by means of lever handles 67, 68 and 69. Lever handles 67, 68 and 69 are pivotally attached by appropriate linkage to connector arms 75, 76 and 77 which carry diaphragms 51, 52 and 54 respectively. The dashed lines 56*a* and 69*a* (see FIG. 3) indicate the park or non-operational positions of diaphragm 56 and handle 69. Because the diaphragms are constructed without springs, the force remains constant irrespective of vertical displacement of the movable plunger. Thus, the diaphragms act as a zero rate spring. A particular suitable air cylinder diaphragm is commercially available from Bellofram Corporation, Burlington, Mass.

The rib portions of sideboard members 37 and 38 are provided with three temporary stops 39 to prevent too much downward pivot of the yoke mounting assembly about pins 36. When the rollers are not over the stationary transparent electrode, the bottom of the yoke side plates or respective rollers rest on the stops 39. Upon actuation of machine drive means to advance the roller carriage 9 and rollers 10, 20 and 30 over stationary electrode 2, when the rollers travel up the beveled ramp 13 the side plates are raised off the temporary stops 39 pivoting about pins 36 to clear the surface of the stationary electrode.

MACHINE DRIVE MECHANISM (FIG. 4)

Figure 4:
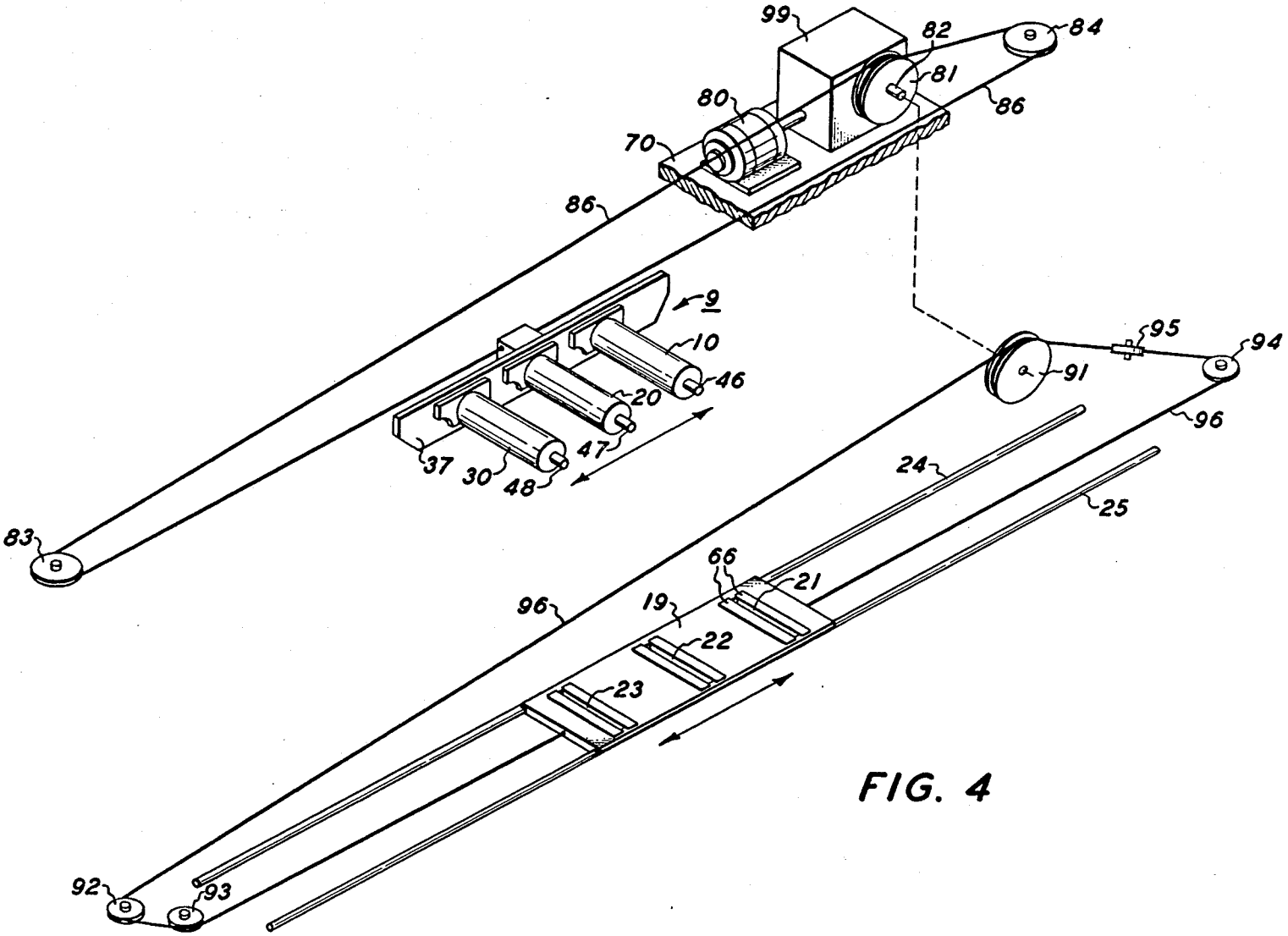
FIG. 4 is a perspective isolated view of the drive mechanism for transporting the carriage which carries the rollers and the slit aperture plate.

Referring to FIG. 4, the machine drive mechanism for propelling the roller carriage 9 and slit aperture plate 19 includes a servo electrical motor 80, used to power driver pulleys 81 and 91, coupled through a gear housing 99. Driver pulleys 81 and 91 are both rigidly contained on the same drive shaft 82 and are thus operated simultaneously. Driver pulley 81 is utilized to propel the carriage 9 and roller over the stationary electrode 2, whereas pulley 91 is used to propel slit aperture plate 19 under the statonary electrode 2 in the manner described supra. It should be appreciated that separate slide means are provided for propelling the carriage 9 and the slit aperture plate 19, i.e., rails 43 for the carriage and the rods 24 and 25 for the slit aperture plate.

As mentioned herein supra, the drive mechanism is designed to correct for parallax during image exposure by synchronizing the relative movement of a roller and its associating exposure aperture or slit such that the slit is properly aligned with the nip formed between roller and stationary electrodes during imaging. To accomplish this correction for parallax, the two driver pulleys 81 and 91 are utilized to cause the carriage 9 and the rollers 10, 20 and 30 to move at a different rate of linear velocity than the velocity rate of the slit aperture plate 19. The pulley 81 is typically about 4 inches in diameter and approximately 0.62 inches wide with 13 grooves per inch across the periphery. The pulley 91, however, is typically about 3.6 inches in diameter and approximately 1.12 inches wide with 13 grooves per inch across the periphery. Because driver pulley 91 is constructed of a smaller diameter than driver pulley 81, the angular velocity of pulley 91 is greater than the angular velocity of pulley 81. Consequently, the slit aperture plate 19, propelled by pulley 91, travels at a slower rate of velocity than that of the carriage 9 and roller electrodes propelled by pulley 81. As explained hereinearlier, this difference in velocity enables a roller to be correctly aligned with its associating exposure slit throughout the advance of the roller across the surface of the stationary electrode. This permits a straight line defining the minimum direct distance between the projected image light source and the nip to always pass through the slit throughout the traverse of the roller across the stationary electrode.

The rotational movement of the driver pulley 81 is coupled to idler pulleys 83 and 84 by the belt 86 attached to the carriage 9 to propel the carriage and rollers across the stationary electrode 2. The rotational movement of pulley 91 is coupled to idler pulleys 92, 93, 94 and 95 by belt 96 attached to the slit aperture plate 19 to propel the slit aperture plate under the stationary electrode 2.

When the carriage 9 and rollers and the slit aperture plate 19 travel the length of the machine, electric motor 80 can be operated in the reverse mode to return the carriage and rollers and the slit aperture plate to their starting point. The image machine 1 may then be operated repeatedly in a series of separate imaging operations. The electrical motor 80 may be operated at variable linear velocities to cause the carriage 9 and rollers to be propelled at velocity rates ranging from about 1.25 to 10 inches per second. In normal operation, the carriage 9 and rollers are propelled at a velociity rate of about 3.5 inches per second, and the slit aperture plate at a rate slightly less than 3.5 inches per second to thereby minimize parallax.

In instances where roller 30 is used as a transfer roller, or whenever it is desired to change the imaging rate suitable cam operated switching circuits may be employed to decrease or increase the velocity rate of the carriage and aperture plate to permit one roller to traverse the stationary electrode at a different rate of velocity than another roller. Likewise, electrical control circuitry may be employed to advance, back-up or stop the carriage and aperture plate at any point of travel across the photoelectrophoretic imaging machine.

ELECTRICAL CONTROL CIRCUIT (FIG. 5)

Figure 5:
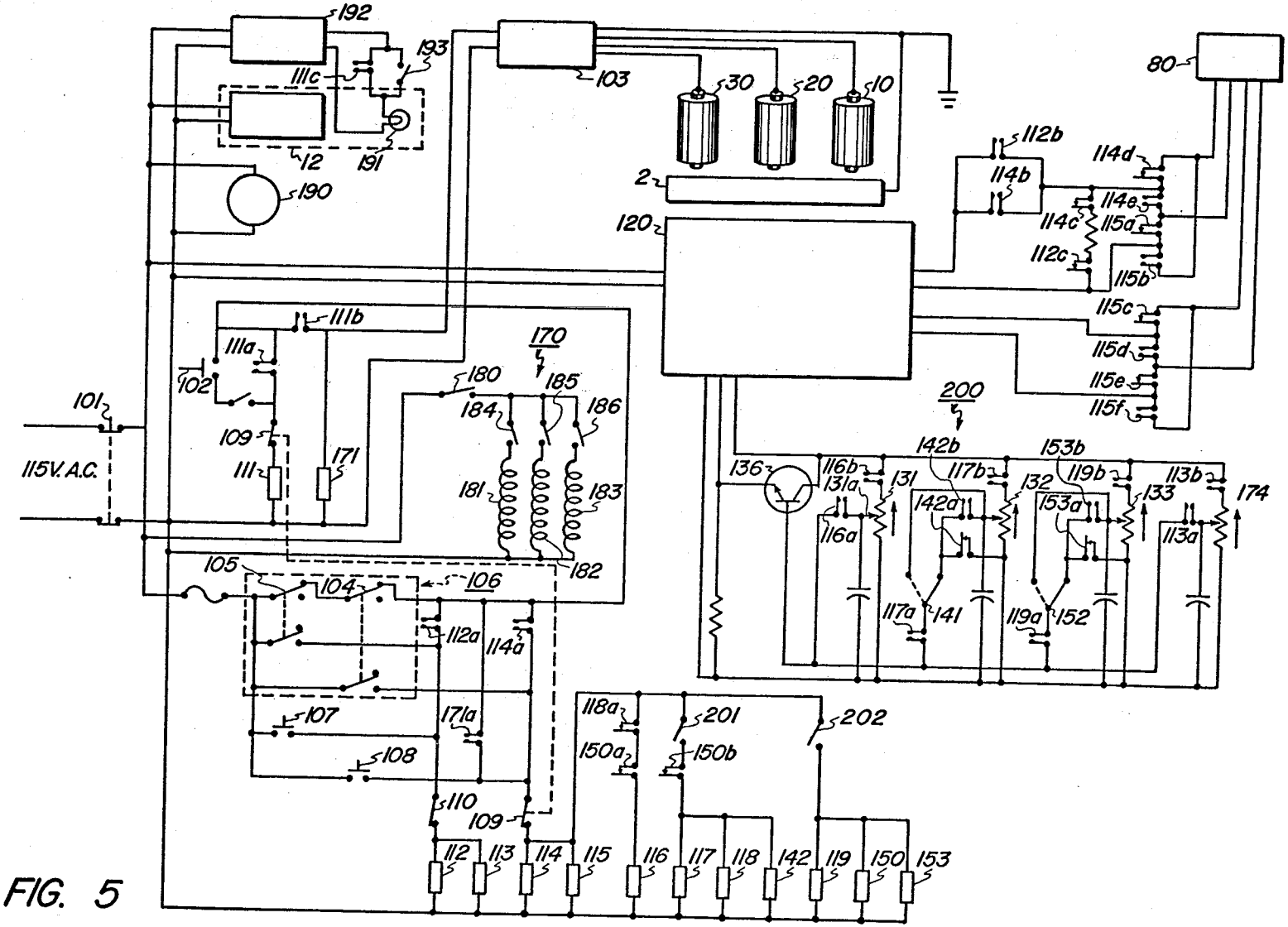
FIG. 5 is a schematic illustration of the electrical circuits employed by the machine of FIGS. 1–4.

The operation of machine 1 is controlled by the electrical circuit shown schematically illustrated in FIG. 5. The electrical control circuit is used for imaging or transferring at variable velocity rates and to predetermine the time interval between successive rollers leaving and entering the imaging region.

The control circuit comprises scanning, jogging and camming switches; time delay relays; an emitter follower amplifier; an electrical motor and a motor control unit. The scanning switches are used to actuate movement of the carriage which carries at least two rollers over a stationary electrode. The jogging switches enable the carriage and rollers to be stopped, backed up or advanced intermittently. The camming switches are located at particular points along the path of travel of the carriage and upon actuation electrical current is coupled to a time delay relay. The time delay relays are used to control the time interval between a roller leaving the imaging region and another roller entering the imaging region. The output from the time delay relay is coupled to the motor control unit which is porgrammed for remote controlling the operation of the electrical motor. The emitter follower amplifier is used to vary the magnitude of the electrical voltage and current supplied to the electrical motor to thereby vary the angular velocity of the electrical motor drive shaft.

It is apparent that the machine 1 may be operated with or without electric field being applied between electrodes. Whenever an image is desired to be formed, however, the print start switch 102 is simply depressed to couple the 115 volt A.C. source to the high voltage power supply 103. The 115 volt A.C. power source is coupled to the voltage source 103 via contacts 111*a* and 111*b* upon actuation of the relay 111. The relay 111 is energized when carriage 9 and rollers 10, 20 and 30 are in the start or far most left position on the machine 1. When the carriage and rollers are thus positioned the "right limit" switch 109 is deactuated and wired closed to thereby couple the 115 volt A.C. line voltage to the relay 111.

The 2PDT switch, generally designated 106, is used to substantially control the movement of the carriage 9 and rollers 10, 20 and 30 when traversing across the surface of the stationary electrode 2. The switch 106 may be utilized to control the direction in which the carriage and rollers move across the surface of the stationary electrode. It is apparent from the explanation given herein supra with regard to the machine exposure and drive mechanism that whenever reference is made to movement of the carriage and rollers there is also a corresponding movement of the slit aperture plate therewith. Therefore, in the description that follows with respect to control of the movement of the carriage and rollers, it is understood to include control of the slit aperture plate that moves simultaneously therewith.

The direction in which the carriage moves is determined essentially by the electrical polarity of the voltage and current supplied to the motor 80. When the motor is energized, its drive shaft is caused to rotate in one direction or the other depending upon the polarity of the voltage and current supplied to the motor. For example, when the polarity is such that the drive shaft rotates in a clockwise direction, the carriage 9 and rollers 10, 20 and 30 move in a direction from right to left across the stationary electrode 2. Conversely, when the polarity of the voltage and current supplied to the motor 80 is such that the drive shaft is caused to rotate in a counter-clockwise direction, the carriage and rollers are moved across the stationary electrode in a reverse direction from left to right. In this respect, the "jog right" switch 104 is utilized to connect the 115 volt A.C. source across the motor 80 in a particular polarity such that the carriage 9 and rollers 10, 20 and 30 move in the direction from right to left. Whereas, the "jog left" switch 105 establishes an electrical voltage and current polarity across the motor 80 such that the carriage 9 and rollers 10, 20 and 30 move in a reverse direction from left to right. It should be noted that movement of the carriage and rollers may be stopped, backed-up or advanced intermittently at any point by simply breaking and closing the connection of the jog switches 104 and 105.

Still referring to FIG. 5, the "scan left" switch 107 and "scan right" switch 108 are employed to actuate the movement of the carriage 9 and rollers 10, 20 and 30. In the case where the carriage 9 and rollers 10, 20 and 30 are in the start or the far most left position, the scan right switch 108 may be used to couple actuating voltage and current through the normally closed "right limit" switch 109 to the relays 114, 115 and 116. The relays 114 and 115 are coupled directly to the motor 80 via contacts 114*b–e* and 115*a–f* respectively to cause the motor to operate initially. The relay 116 momentarily energizes contacts 116*a* and is then coupled to the motor control unit 120 which is programmed for controlling the operation of motor 80 by remote control.

Now in the case where the carriage and rollers 10, 20 and 30 are in the far most right position, the scan left switch 107 may be used to couple actuating voltage and current through the normally closed left limit switch 110 to the relays 112 and 113. Relays 112 and 113 are also coupled to the motor control unit 120.

The motor control unit 120 used for remote controlling the operation of the motor 80 is programmed to cause the drive shaft of the motor to rotate at variable velocities. A suitable motor control unit for accomplishing this purpose is the "Master Control," Model E650M, commercially available from Electro Craft Corporation, Hopkins, Minn.

The motor control unit 120 may be uniquely employed in this machine to facilitate imaging and transfer at variable roller speeds. For example, the linear rate of velocity in which the three rollers 10, 20 and 30 traverse across the surface of the stationary electrode 2 may be varied from about 1.25 to 10 inches per second by effectively controlling the magnitude of the voltage and current supplied to the motor by the emitter follower amplifier circuit generally designated 200. First, in the case when the carriage and rollers are in the start or far most left position, the "right limit" switch 109 is closed. This energizes relays 114, 115 and 116. The relays 114 and 115 are coupled through the motor control unit 120 to the motor 80 to cause the drive shaft to rotate in a clockwise direction at a predetermined velocity. The relay 116, in series with contacts 118*a* of relay 118 and contact 150*a* of the relay 150, is coupled to the emitter follower amplifier circuit 200 via potentiometer 131 which controls the level of voltage and current coupled to the motor control unit 120. The relay contacts 116*a* of the relay 116 are coupled to the sliding contact 131*a* of the potentiometer 131. The magnitude of electrical voltage and current may be increased or decreased by manually adjusting the sliding contact 131*a*. The transistor 136 couples the output from the emitter follower amplifier circuit to the motor control unit 120 via contacts 116*b* with approximately unity gain. The relay 116 is operable during the time in which the roller 10 is traveling within the imaging region across the surface of the stationary electrode 2. Thus, the linear rate of velocity in which roller 10 travels during photoelectrophoretic imaging is effectively controlled by potentiometer 131 by manually adjusting the magnitude of the electrical voltage and current supplied to the electric motor 80.

As the carriage 9 continues its movement across the machine 1, the physical motion of the carriage actuates the cam actuated switch 201 thereby activating the relays 117 and 118 and 142. The cam actuated switch 201 is in series with the normally closed contacts 150*b* of the relay 150. Therefore, when the switch 201 is closed and relay 150 energized, the normally closed relay contacts 150*a* and contacts 150*b* in series with the relay 116 are opened. The normally closed contact 118*a* for relay 118 is opened when switch 201 is closed.

The relay 142 is a time delay relay adjustable by conventional means (not shown) for a delay of about 0.5 to 30 seconds. The time delay relay 142 may be used to control the time interval between the roller 10, leaving the imaging region and roller 20 entering the imaging region. When the switch 141 is in the "on" position and contacts 117*a* are closed, contact 132*a* of the potentiometer 132 will be connected to the active part of the emitter follower amplifier circuit 200 via the time delay relay contacts 142*b*. When switch 141 is in the "off" position, sliding contact 132*a* will be connected to the active part of the emitter follower amplifier circuit 200 via switch 141 only, hence, in this case there is no time delay. The magnitude of the electrical voltage and current coupled from the emitter follower amplifier to the motor control unit via contacts 117*b* may be increased or decreased by manually adjusting the sliding contact 132*a*.

As the roller 20 traverses out of the imaging region over the stationary electrode 2, and as roller 30 enters, the cam actuated switch 202 is activated thereby energizing the relays 119, 150 and 153. When the relay 150, in series with the cam actuated switch 202 is energized, the normally closed contacts 150*a* and 150*b* of relay 150 are opened thereby de-energizing relays 116, 117, 118 and 142.

The relay 153 is also a time delay relay adjustable for a time delay of about 0.5 to 30 seconds. The relay 153 may be used to control the time interval between roller 20 leaving the imaging region and roller 30 entering the imaging region. When the switch 152 is in the on position and the contacts 119*a* are closed, sliding contact 133*a* of the potentiometer 133 will be connected to the active part of the emitter follower amplifier circuit 200 via the time delay relay contacts 153*b*. When the switch 152 is in the off position, the sliding contact 133*a* will be connected to the active part of the emitter follower amplifier circuit 200 via switch 152 only, hence, in this case there will be no time delay. In this case, the emitter follower amplifier circuit 200 output is coupled to the motor control unit 120 via contacts 119*b* with unity gain.

When the carriage 9 and the rollers 10, 20 and 30 have traveled completely across the surface of the stationary electrode 2 to the far most right position the right limit switch 109 is opened. The relays 112 and 113 are energized and the carriage 9 and the rollers 10, 20 and 30 may be caused to travel in the reverse direction. In this case, the magnitude of the voltage and current to the electric motor 80 is effectively controlled by the potentiometer 174 and sliding contact 174*a*. The emitter follower amplifier circuit 200 output is coupled to the motor control unit 120 via contacts 113*b*. However, the velocity of the carriage and rollers across the stationary electrode 2 traveling in the reverse or right to left direction remains constant. As the carriage and roller electrodes move in a right to left direction, cam actuated switches 201 and 202 are physically opened in a reverse order. First, cam actuated switch 202 is opened and then cam actuated switch 201 is opened. Consequently, when the carriage 9 and rollers 10, 20 and 30 have traveled completely across the stationary electrode 2 back to their respective starting positions, the carriage and rollers are stopped when left limit switch 110 is opened. The carriage and rollers may then be propelled for another pass over the stationary electrode by depressing scan right switch 108.

The air main switch 180 is used to couple the 115 volt A.C. power source to actuating solenoids 181, 182 and 183. These solenoids 181, 182 and 183 are utilized to couple power to the diaphragm air cylinders 54, 55 and 56 respectively (see FIGS. 1 and 2). The diaphragm air cylinders may be independently energized or de-energized to thereby selectively release the air pressure from the diaphragm air cylinders. The solenoid 181 and thus diaphram air cylinder 54, may be operated by the control switch 184. The solenoid 182 and thus diaphragm air cylinder 55, may be operated by the switch 185. Likewise, the solenoid 183 and thus diaphragm air cylinder 56, may be operated by the control switch 186.

The lamp 191 of the projector 12 is connected to the 115 volt A.C. power source through the line regulator 192 to protect the lamp from power surges and hold the 115 volt A.C. power source constant. The lamp control switch 193 may be used to connect the lamp to the line voltage via the contacts 111*c* without completely turning on the start print switch 102.

IN OPERATION

One example of the apparatus hereof in operation is as follows:

The photoelectrophoretic ink or imaging suspension is first coated on the stationary transparent electrode 2. This photoelectrophoretic ink or suspension is any suitable photoresponsive particle in an insulating carrier liquid and may, for example, comprise the imaging suspension described in the aforementioned U.S. Pat.

No. 3,384,488 of Tulagin et al. The inking of the stationary electrode 2 and/or the first roller can be accomplished by pouring a photoelectrophoretic ink onto the surface of roller 10 or electrode 2, or by any appropriate inking means to form a layer thickness of about 1.5 mils. After the coating of imaging suspension has been applied, a voltage of approximately +2500 volts is applied to the core of roller electrode 10. The roller 10 is rolled into contact with the imaging suspension. The roller 10 is moved across stationary electrode 2 by machine drive mechanism at a speed of about 3.5 inches per second. Simultaneously, the projector 12 illuminates and projects a light image of a full color transparency via mirror 71 onto the interface or nip between the roller 10 and the stationary electrode 2.

Diaphragm air cylinder 54, coupled to an air pressure source of 20 p.s.i., is mounted above roller 10 on carriage 9 to allow a constant down force to be applied to the yoke mounting assembly. The shaft 46 of roller 10 is mounted to roller carriage 19 by the detachable yoke mounting assembly. The diameter of roller 10 is 4 inches in diameter, therefore, the shaft is positioned by the bearing blocks at the highest point in the side plates by the set screws. A second roller 20, 4 inches in diameter identical to roller 10, is selected and positioned by the detachable yoke mounting assembly on the roller carriage 9 in a similar fashion with a downward force of 20 p.s.i. being applied. Approximately 2500 volts positive is applied to the core of roller 20. The second roller 20 travels along the same path as that traveled by roller 10 and at the same speed. As roller 20 enters the imaging region, the projector 12 continuously illuminates and projects the same light image as was projected when roller 10 was moved into interface with the stationary electrode 2. This second subjection of imaging suspension to exposure and field has the effect of improving the quality of the image produced after roller 10 completes its contact with stationary electrode 2.

Still a third roller electrode 30 is selected and positioned on the roller carriage 9 in the same manner as rollers 10 and 20 with a downward force of about 20 p.s.i. applied. This third roller 30 is also 4 inches in diameter and identical to rollers 10 and 20. However, roller 30 is used as a transfer roller. A transfer sheet is affixed around the periphery of the roller 30 prior to mounting of the roller. The voltage applied to the core of roller 30 is opposite in polarity from that of rollers 10 and 20. Specifically, approximately −1700 volts is applied to the core of roller 30. The roller 30 travels the same path as traveled by rollers 10 and 20, however, upon roller 30 entering the imaging region, the electrically controlled cam operated switch decreases the speed of electrical motor 80 to a roller transfer speed of approximately 1.5 inches per second. As the roller electrodes 10, 20 and 30 are shuttled across stationary electrode 2, the roller electrodes are rotated by auxiliary drive mechanism at an angular velocity to establish substantially a zero relative velocity between points on the peripheries of the roller and points on the surface of the stationary electrode 2.

Simultaneously, with the propelling of the roller carriage 9 and the rollers across the surface of the stationary electrode 2, machine drive means also propels the slit aperture plate 19 in a path parallel to that traveled by the carriage and rollers but beneath the carriage and the rollers. Slit aperture plate 19, with exposure slits 21, 22 and 23, arrives in the imaging region in time in advance of associating roller electrodes 10, 20 and 30 respectively, and remains within the imaging region in time after an associating roller electrode has moved beyond the imaging region. The width of exposure slits 21 and 22 are set at a width of approximately one-half inch and exposure slit 23 adjusted approximately zero width and sealed off for transfer in the absence of light. The exposure slit 21 arrives in the imaging region at a point such that the center of the slit is aligned vertically in advance of the center of the nip formed between roller 10 and electrode 2. However, because the slit aperture plate 19 is caused to travel at a slower velocity than that of the rollers across the surface of the stationary electrode 2, the center of the slit 21 is aligned vertically behind the center of the nip formed between roller 10 and the electrode 2 when the roller 10 exits the imaging region.

The diameter of pulley 81 is directly proportional to the diameter of pulley 91 by:

$$\frac{D_1}{D_2} = \frac{P_1}{P_2}$$

where:

$D_1$ = the distance from the projected center line of the projector lens to the top of the NESA glass;

$D_2$ = the distance from the projected center line of the projector lens to the top of the slit aperture plate;

$P_1$ = the diameter of pulley 81; and $P_2$ = the diameter of pulley 91.

The diameter of $P_1$ is usually fixed at about 4 inches and where $D_1 = 20$ inches and $D_2 = 18$ inches $P_2$ is approximately 3.6 inches. Therefore, the distance that the carriage and the rollers moves is proportional to the distance that the slit aperture plate moves, or:

$$\frac{S_1}{S_2} = \frac{\pi P_1}{\pi P_2}$$

where:

$S_1$ = the distance that the carriage and roller moves; and $S_2$ = the distance that the slit aperture plate moves.

Thus, where the stationary electrode is 6 × 6 inches square, when the carriage and rollers move the 6 inches across the stationary electrode, the slit aperture plate moves approximately 5.4 inches during the same time interval. Consequently, the exposure slits arrive in the imaging region approximately 0.30 inches in advance of the center of the nip formed between an associating roller electrode and the stationary electrode and exit the imaging region approximately 0.30 inches behind the center of the nip.

A similar relationship also exits between the roller 20 and exposure slit 22, therefore, the explanation above, with respect to the roller 10 and the slit 21, should also apply to roller 20 and exposure slit 22.

After the rollers 10 and 20 have passed over the stationary transparent electrode 2, an image of suitable quality is observed on the layer of imaging suspension coated on the stationary transparent electrode 2. Then when transfer roller 30 travels over the stationary transparent electrode 2 in contact with the imaging suspension, the image is transferred onto the transfer sheet wrapped around the roller 30. Thus, the originally projected image is substantially reproduced on the transfer sheet.

Other modifications to the above described invention will be apparent to those skilled in the art and are intended to be incorporated herein.

What is claimed is:

1. Apparatus for contacting a roller to a surface to be contacted comprising:

a. a carriage comprising right and left spaced apart sideboards;

b. a mount on the carriage, the mount comprising left and right spaced apart side plates within the carriage sideboards, the mount side plates being pivotally connected to the sideboards, wherein the mount pivots about an axis parallel to a surface to be contacted and perpendicular to the direction of advancement of the carriage and the mount;

c. at least one roller rotatably mounted to the mount to permit the roller to pivot in a plane perpendicular to the direction of advancement of the roller, and about an axis parallel to the surface to be contacted;

d. pivot stop means carried by the carriage sideboards to stop the downward pivot of the mount and the roller at a predetermined position when the roller is not over the surface to be contacted;

e. drive means for advancing the carriage, the mount and the roller into contact with the surface to be contacted;

f. force means carried by the carriage for applying a downward force over and above gravitational force to the mount and thereby to the roller when the surface of the roller is in contact with the surface to be contacted; and g. beveled ramps adjacent to, and in the direction of advancement of the roller, prior to the surface to be contacted to permit the roller to contact the beveled ramps to gradually raise the roller to the elevation of the top of the surface to be contacted to permit the roller to pass across the surface to be contacted, the beveled ramps at the same time gradually raising the mount off the pivot stop means.

2. Apparatus for contacting a roller to a surface to be contacted comprising:

a. a carriage comprising right and left spaced apart sideboards;

b. a mount on the carriage, the mount comprising left and right spaced apart side plates within the carriage sideboards and a crossbeam connecting the side plates, each end of the crossbeam being connected to a side plate by a dowel rigidly connected to the side plate and loosely coupled to the cross beam, the mount side plates being pivotally connected to the sideboards, wherein the mount pivots about an axis parallel to a surface to be contacted and perpendicular to the direction of advancement of the carriage and the mount;

c. at least one roller rotatably mounted to the mount to permit the roller to pivot in a plane perpendicular to the direction of advancement of the roller and about an axis parallel to the surface to be contacted;

d. drive means for advancing the carriage, the mount and the roller into contact with the surface to be contacted; and e. force means carried by said carriage and adapted to apply a downward force over and above gravitational force to the crossbeam and thereby to the mount and roller when the surface of the roller is in contact with the surface to be contacted.

3. Apparatus for contacting a roller to a surface to be contacted comprising:

a. a carriage comprising right and left spaced apart sideboards, the carriage being mounted on guide rails for advancement over the surface to be contacted;

b. a mount on the carriage, the mount comprising left and right spaced apart side plates within the carriage sideboards, the mount side plates being pivotally connected to the sideboards, wherein the mount pivots about an axis parallel to the surface to be contacted and perpendicular to the direction of advancement of the carriage and the mount;

c. at least one roller rotatably mounted to the mount to permit the roller to pivot in a plane perpendicular to the direction of advancement of the roller and about an axis parallel to the surface to be contacted;

d. drive means for advancing the carriage, the mount and the roller into contact with the surface to be contacted;

e. force means carried by the carriage for applying a downward force over and above gravitational force to the mount and thereby to the roller when the surface of the roller is in contact with the surface to be contacted; and f. auxiliary drive means for rotating the roller when the roller passes over the surface to be contacted, independent of the rotation forces that may be imparted to the roller by surface contact of the roller to a surface to be contacted comprising a roughened track adjacent to and in the direction of advancement of the roller along the surface to be contacted, and a disc, the shaft of the roller passing through the center of the disc to secure it in non-slipping contact to the shaft, the surface of the disc being in frictional contact with the roughened track.

4. Apparatus for contacting a roller to a surface to be contacted comprising:

a. a carriage comprising left and right spaced apart sideboards;

b. a mount on the carriage, the mount comprising left and right spaced apart side plates within the carriage sideboards and a crossbeam connecting the side plates, each end of the crossbeam being connected to a side plate by a dowel rigidly connected to the side plate and loosely coupled to the crossbeam, the mount side plates being pivotally connected to the sideboards, wherein the mount pivots about an axis parallel to the surface to be contacted and perpendicular to the direction of advancement of the carriage and the mount;

c. at least one roller rotatably mounted to the mount to permit the roller to pivot in a plane perpendicular to the direction of advancement of the roller and about an axis parallel to the surface to be contacted;

d. drive means for advancing the carriage, the mount and the roller into contact with the surface to be contacted;

e. pivot stop means carried by the carriage sideboards to stop the downward pivot of the mount and the roller at a predetermined position when the roller is not over the surface to be contacted;

f. force means carried by the carriage for applying a downward force, over and above, gravitational force to the crossbeam and thereby to the mount and the roller when the surface of the roller is in contact with the surface to be contacted; and g. beveled ramps adjacent to and, in the direction of advancement of the roller, prior to the surface to be contacted to permit the roller to contact the beveled ramps to gradually raise the roller to the elevation of the top of the surface to be contacted to permit the roller to pass across the surface to be contacted, the beveled ramps at the same time gradually raising the mount off the pivot stop means.

* * * * *